US006047423A

United States Patent [19]

Larson

[11] Patent Number: 6,047,423

[45] Date of Patent: Apr. 11, 2000

[54] AIR MATTRESS WITH FIRMNESS ADJUSTING AIR BLADDERS

[76] Inventor: Lynn D. Larson, 5410 NW. 44th St., Lincoln, Nebr. 68524

[21] Appl. No.: 09/122,943

[22] Filed: Jul. 27, 1998

[51] Int. Cl.[7] ..... A47C 27/12; A47C 27/14

[52] U.S. Cl. ..... 5/709; 5/710; 5/713

[58] Field of Search ..... 5/706, 709, 710, 5/713, 719, 654

[56] References Cited

U.S. PATENT DOCUMENTS

| | | | |
|---|---|---|---|
| 2,328,083 | 8/1943 | Lineback | 5/709 |
| 3,583,008 | 6/1971 | Edwards | 5/710 X |
| 4,947,500 | 8/1990 | Seiler | 5/713 |
| 5,060,328 | 10/1991 | Larson | 5/450 |
| 5,159,725 | 11/1992 | Larson | 5/451 |
| 5,253,377 | 10/1993 | Larson | 5/451 |
| 5,335,380 | 8/1994 | Larson | 5/255 |
| 5,638,565 | 6/1997 | Pekar | 5/710 |
| 5,740,573 | 4/1998 | Boyd | 5/711 |
| 5,797,155 | 8/1998 | Maier et al. | 5/654 |

*Primary Examiner*—Terry Lee Melius
*Assistant Examiner*—James M Hewitt
*Attorney, Agent, or Firm*—Zarley, McKee, Thomte, Voorhees & Sease; Dennis L. Thomte

[57] ABSTRACT

A fluid-filled mattress with firmness adjusting air bladders is provided wherein the individual bladders may be individually inflated and deflated to provide precise firmness adjustment. Further, a computer control of the bladders may be utilized to adjust the firmness of the air bladders.

8 Claims, 3 Drawing Sheets

AIR MATTRESS WITH FIRMNESS ADJUSTING AIR BLADDERS

TECHNICAL FIELD

The present invention is directed generally to air mattresses, and more particularly to an improved air mattress having a plurality of vertically oriented internal air springs for auxiliary support of loads placed on the matress.

BACKGROUND OF THE INVENTION

Improved sleep is experienced on waterbed and air matresses (hereinafter fluid-filled mattresses), compared to sleep on the conventional mattress, because the support forces are more uniformly distributed across the body, thereby substantially eliminating localized pressure points. The same characteristic, however, makes the top surface of a fluid-filled mattress more susceptible to deflection by a concentrated load, which occurs in the area of the hips of a person lying in a prone position on the mattress. Internal baffling systems and foam and fiber fillers have been incorporated into fluid-filled mattresses to eliminate wave action (in waterbed mattresses) and to restrict fluid flow therein. However, such attempts have only indirectly improved the resistance of the fluid-filled mattress surface to deflection by a concentrated load.

SUMMARY OF THE INVENTION

It is therefore a general object of the present invention to provide an improved fluid-filled mattress with firmness adjusting air bladders.

Another object is to provide a fluid-filled mattress with firmness adjusting air bladders wherein the individual bladders may be individually inflated and deflated to provide precise firmness adjustment.

Yet a further object is to provide an improved fluid-filled mattress with firmness adjusting air bladders wherein a computer control of the bladders may be utilized to adjust the firmness of the air bladders.

These and other objects of the present invention will be apparent to those skilled in the art.

DESCRIPTION OF THE PREFERRED EMBODIMENT

Figure 1:
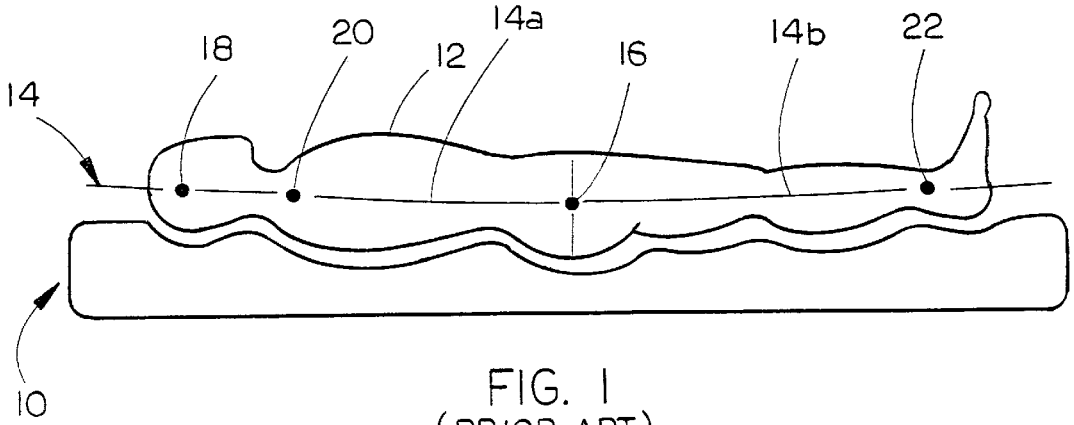
FIG. 1 (PRIOR ART)
FIG. 1 is a schematic view of a prior art fluid-filled mattress.

Referring now to the drawings, in which similar or corresponding parts are identified with the same reference numeral, and more particularly to FIG. 1, a prior art fluid-filled mattress 10 is shown, with a person 12 lying prone thereon. A longitudinal axis 14 of the person is shown, and it can be seen that the prior art mattress does not maintain axis 14 in a straight line. Rather, the midpoint 16 of the person 12 will sink lower into mattress 10 and other portions of the body, thereby causing the head 18, shoulders 20 and midpoint 16 to form an upper axis 14*a* which is misaligned from the lower axis 14*b* formed between midpoint 16 and feet 22.

Figure 2:
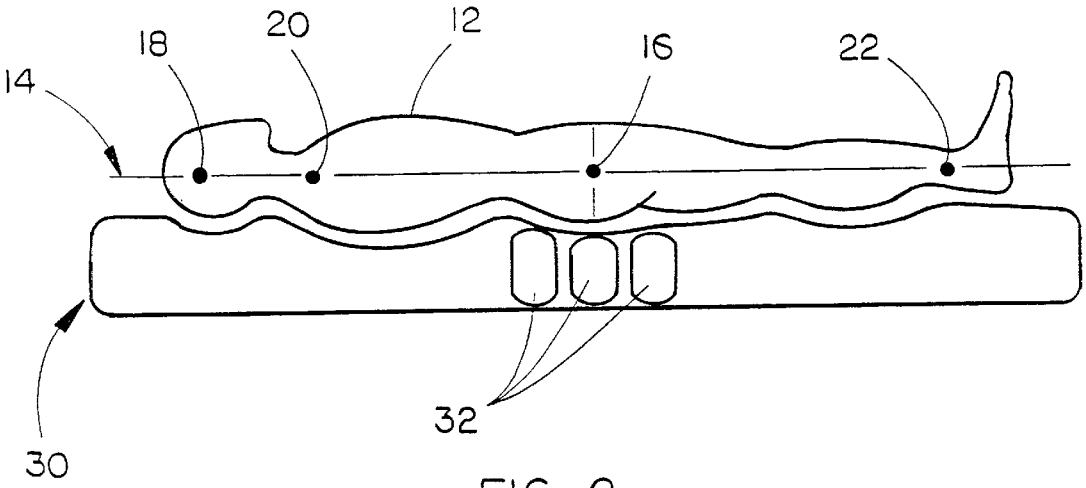
FIG. 2 is a schematic view of the mattress with air springs of the present invention.

Referring now to FIG. 2, the fluid-filled mattress of the present invention is designated generally at 30, and includes a plurality of air bladders 32 positioned within mattress 30, to provide auxiliary support in desired locations. As shown in FIG. 2, air bladders 32 will provide auxiliary support to midpoint 16 of the occupant 12 such that the head 18, shoulders 20, midpoint 16 and feet 22 are all aligned along longitudinal axis 14.

Figure 4:
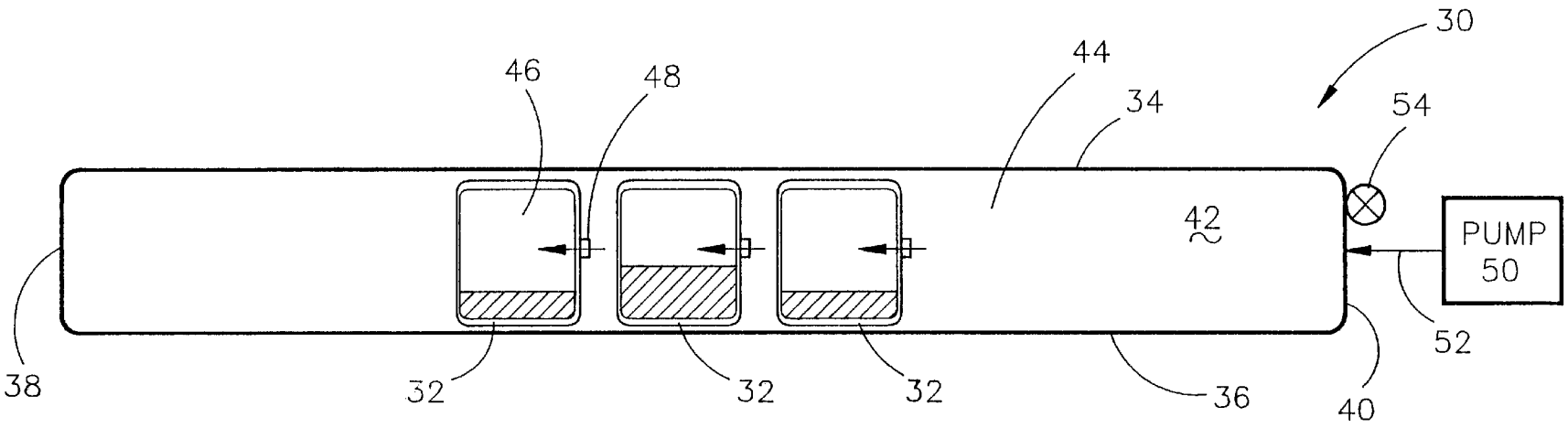
FIG. 4 is an enlarged schematic view of the fluid-filled mattress of the present invention.
Figure 5:
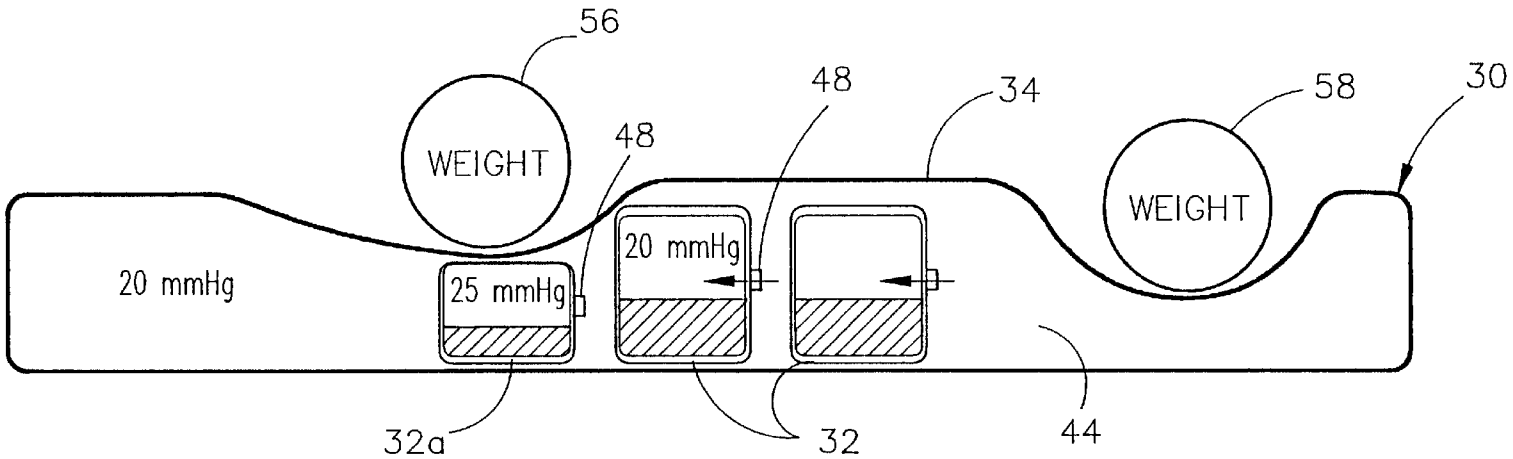
FIG. 5 is a schematic view similar to FIG. 4, but with localized weights placed thereon.

Referring now to FIGS. 4 and 5, the fluid-filled mattress 30 of the present invention is shown in more detail. Mattress 30 includes upper and lower walls 34 and 36, end walls 38 and 40 and opposing side walls 42, to form a hollow airtight chamber 44.

Each air bladder 32 is filled with a block 46 of resilient compressible material, so that it will return to its expanded condition after being compressed. Each bladder also includes a one-way check valve 48 which permits fluid flow into the bladder 32, but prevents fluid flow out of the bladder 32. Check valve 48 may also be manually operable to permit the release of fluid within each bladder 32.

Air bladders 32 are preferably positioned generally centrally between the ends 38 and 40 of mattress 30, and the entire extent of the width of the mattress between side walls 42. Each air bladder 32 also preferably extends substantially completely between the upper and lower walls 34 and 36 of mattress 30.

A pump 50 is provided with a pneumatic line 52 to inflate mattress 30 as desired. An operable valve 54 in mattress 30 permits the selective exhaust of air from mattress 30 to adjust the mattress to the desired firmness.

As shown in FIG. 5, two weights 56 and 58 have been placed on the upper wall 34 of mattress 30. Weight 56 is positioned over air bladder 32*a*, while weight 58 is positioned over a portion of the mattress with no air bladders. When mattress 30 is initially inflated with pump 50 (shown in FIG. 4) the block of resilient compressible material 46 within each air bladder 32 will expand to its fully expanded position, memory of the compressible material. This expansion will draw air from chamber 44 into each of the air bladders 32, until each compressible block 46 has reached its fully expanded condition. Obviously, each compressible block 46 may be provided a different dimension, so as to reach a predetermined pressure within the air bladders 32. In this way, different pressures may be achieved within independent air bladders 32, if so desired.

The placement of weights 56 and 58 on mattress 30 will uniformly increase the pressure throughout the chamber 44. The position of weight 56 atop bladder 32*a* will cause physical compression of air bladder 32*a*, thereby increasing the pressure therein. Because check valves 48 will not release fluid from bladder 32*a*, the bladder 32*a* will act as an auxiliary air support spring for weight 56. Because weight 58 has no air spring providing auxiliary support, weight 58 will depress the upper wall 34 downwardly to a greater extent than weight 56. It can therefore be seen that air bladders 32 will provide auxiliary support within chamber 44 of mattress; 30.

Figure 3:
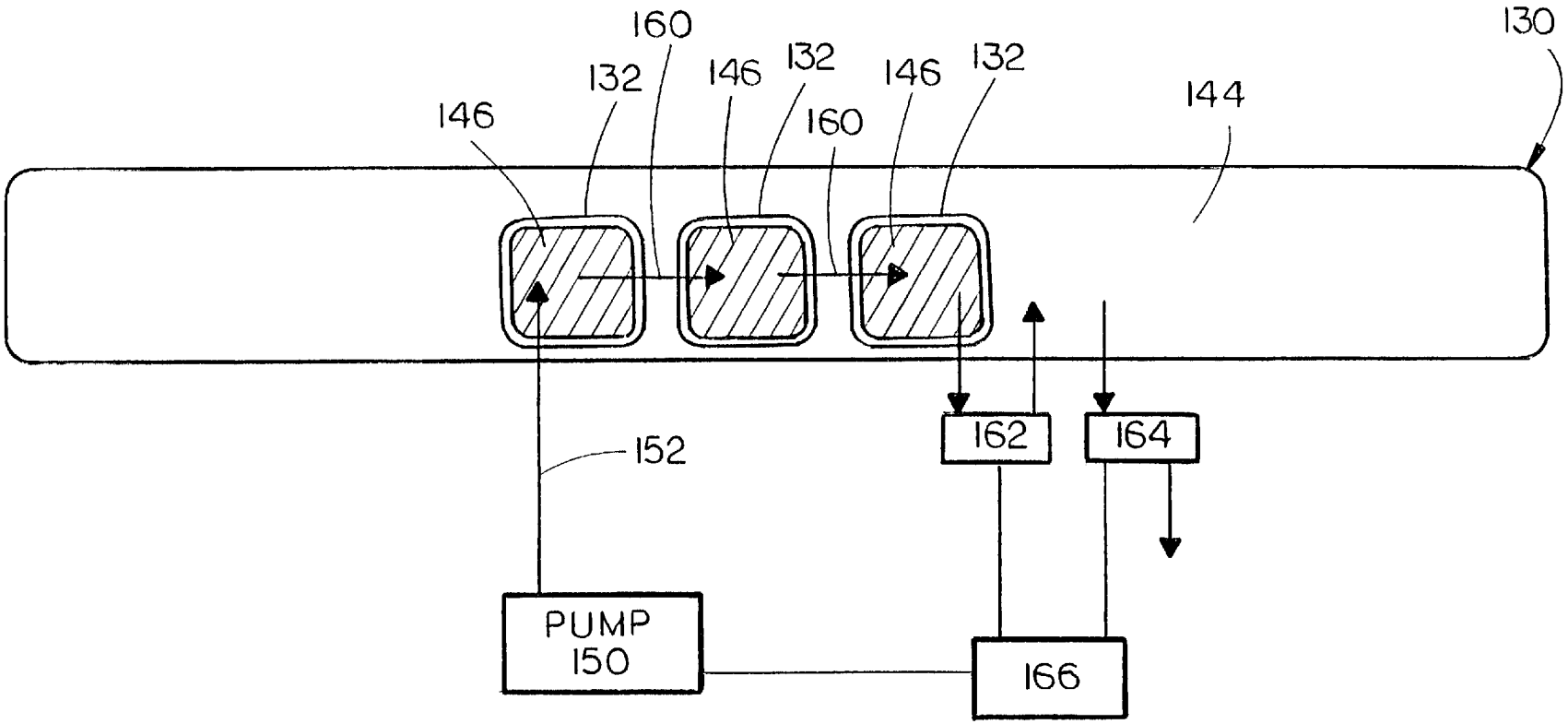
FIG. 3 is a schematic view of a second embodiment of the invention with computer controlled firmness control.

Referring now to FIG. 3, a second embodiment of the fluid-filled mattress is designated generally at 130, and includes air chamber 144, and a plurality of air bladders 132 therein. Air bladders 132 are each substantially filled with a compressible material, such as a fibrous batting or a spongelike material. The main difference between the first and second embodiments of the air mattress is in the use of pneumatic lines 160 which interconnect air bladders 132, and the use of pneumatic line 152 from pump 150 to provide the desired air pressure within bladders 132.

The bladders 132 which is at the downstream end of the bladder 132 is fluidly connected to an operable valve 162 which is selectively operable to release air from air bladders 132 into air chamber 144. A second valve 164 in mattress 130 will selectively release air from chamber 144 to the surrounding atmosphere.

A control unit 166 is electronically connected to pump 150 and valves 162 and 164, and is programmed to adjust the pressures of the bladders 132 and mattress 130 as desired.

Whereas the invention has been shown and described in connection with the preferred embodiment thereof, many modifications, substitutions and additions may be made which are within the intended broad scope of the appended claims.

I claim:

1. A fluid-filled mattress with auxiliary support, comprising:

a fluid-filled mattress having upper and lower walls, opposing side walls and opposing end walls, forming an enclosed chamber;

an operable pump fluidly connected to said chamber to selectively pump fluid into said chamber;

a first bladder disposed within said chamber and extending substantially from said lower wall to the said upper wall; and a block of resilient compressible material which returns to an expanded condition mounted within said first bladder;

said first bladder filled with compressible fluid to a predetermined pressure, to provide auxiliary support for an object resting on said upper wall of the mattress above said first bladder;

said first bladder including a one-way check valve provided therein permitting fluid flow into said first bladder and preventing fluid flow out of said first bladder.

2. A fluid-filled mattress with auxiliary support, comprising:

a fluid-filled mattress having upper and lower walls, opposing side walls and opposing end walls, forming an enclosed chamber;

an operable pump fluidly connected to said chamber to selectively pump fluid into said chamber;

a first bladder disposed within said chamber and extending substantially from said lower wall to the upper wall; and a block of resilient compressible material which returns to an expanded condition mounted within said first bladder;

said first bladder filled with compressible fluid to a predetermined pressure, to provide auxiliary support for an object resting on said upper wall of the mattress above said first bladder;

said compressible fluid in said first bladder being a gas;

said fluid filling said mattress being a gas;

said block of resilient compressible material being a fibrous batt;

said first bladder including a one-way check valve provided therein permitting fluid flow into said first bladder and preventing fluid flow out of said first bladder;

said mattress further comprising a second gas-filled bladder disposed within said chamber and extending substantially from said lower wall to said upper wall;

a block of resilient compressible material which returns to an expanded condition mounted within said second bladder;

said second bladder filled with compressible fluid to a predetermined pressure;

said second bladder being fluidly connected to said first bladder, such that both bladders have equal pressures;

said pump being fluidly connected to said first bladder, and further comprising an operable valve in said second bladder for selectively exhausting fluid from said second bladder into said mattress.

3. A fluid-filled mattress with auxiliary support, comprising:

a fluid-filled mattress having upper and lower walls, opposing side walls and opposing end walls, forming an enclosed chamber;

an operable pump fluidly connected to said chamber to selectively pump fluid into said chamber;

a first bladder disposed within said chamber and extending substantially from said lower wall to said upper wall thereof; and a block of resilient compressible material which returns to an expanded condition mounted within said first bladder;

said first bladder filled with compressible fluid to a predetermined pressure, to provide auxiliary support for an object resting on said upper wall of said mattress above said first bladder;

said compressible fluid in said first bladder being a gas;

said fluid filling said mattress being a gas;

said block of resilient compressible material being a fibrous batt;

said first bladder including a one-way check valve provided therein permitting fluid flow into said first bladder and preventing fluid flow out of said first bladder.

4. The mattress of claim 3 wherein said mattress includes an operable mattress valve formed therein, operable to selectively exhaust fluid from the mattress.

5. The mattress of claim 4 further comprising a programmable control unit electrically connected to the pump and the mattress valve, for selectively adjusting the pressure within the mattress.

6. The mattress of claim 5, further comprising:

a second gas-filled bladder disposed within the chamber and extending substantially from the lower to the upper wall;

a block of resilient compressible material which returns to an expanded condition, mounted within the second bladder; and the second bladder filled with compressible fluid, to a predetermined pressure.

7. The mattress of claim 6 wherein the second bladder is fluidly connected to the first bladder, such that both bladders have equal pressures.

8. The mattress of claim 7 further comprising an operable valve in said second bladder for selectively exhausting fluid from said second bladder into the mattress, and wherein said pump is fluidly connected to the mattress by way of said first bladder, said second bladder, and said operable valve.

* * * * *